US010094168B2

(12) United States Patent
Haapalahti et al.

(10) Patent No.: US 10,094,168 B2
(45) Date of Patent: Oct. 9, 2018

(54) METHOD AND FASTENING ELEMENT FOR INSTALLING A SUNSHADE IN A GLAZING PART

(71) Applicant: Suomen Visor Oy, Kempele (FI)

(72) Inventors: Teuvo Haapalahti, Oulunsalo (FI); Esa Hilliaho, Valkeala (FI); Markku Lehtonen, Kuusankoski (FI); Markku Pulkkinen, Tupos (FI); Chad Simonson, Kempele (FI)

(73) Assignee: Suomen Visor Oy, Kempele (FI)

( * ) Notice: Subject to any disclaimer, the term of this patent is extended or adjusted under 35 U.S.C. 154(b) by 337 days.

(21) Appl. No.: 14/836,622

(22) Filed: Aug. 26, 2015

(65) Prior Publication Data

US 2016/0186487 A1 Jun. 30, 2016

(30) Foreign Application Priority Data

Aug. 28, 2014 (FI) ..... 20145746

(51) Int. Cl.

| | |
|---|---|
| ***E06B 9/30*** | (2006.01) |
| ***E06B 9/388*** | (2006.01) |
| ***A47H 1/13*** | (2006.01) |
| ***E06B 9/327*** | (2006.01) |

(52) U.S. Cl.

CPC ..... *E06B 9/30* (2013.01); *A47H 1/13* (2013.01); *E06B 9/327* (2013.01); *E06B 9/388* (2013.01)

(58) Field of Classification Search

CPC . E06B 9/30; E06B 9/327; E06B 9/388; A46H 1/13

See application file for complete search history.

(56) References Cited

U.S. PATENT DOCUMENTS

2013/0119656 A1* 5/2013 Lee ..... F16B 7/1418 285/312

FOREIGN PATENT DOCUMENTS

| | | |
|---|---|---|
| DE | 299 07 809 | 7/1999 |
| DE | 20 2005 007 376 | 9/2005 |
| DE | 102009008461 | 8/2010 |
| DE | 20 2013 100 640 | 11/2013 |
| EP | 1022428 | 7/2000 |
| FI | 7955 | 7/2008 |

OTHER PUBLICATIONS

Machine translation of DE 20 2005 007 376 obtained from espacenet.com.*

European Search Report, EP Patent Application No. 15182917.3, dated Jan. 7, 2016.

Search Report for FI 20145746 dated Mar. 17, 2015.

* cited by examiner

*Primary Examiner* — Moshe Wilensky

(74) *Attorney, Agent, or Firm* — Andrus Intellectual Property Law, LLP

(57) ABSTRACT

A sunshade is installed to a glazing part, which comprises a transparent sheet with a first end edge and second end edge and a first side edge and second side edge. The side edges are free edges of the sheet. At least one first fastening element is attached close to the first end edge of the transparent sheet and at least one second fastening element is attached close to the second end edge of the transparent sheet, and the sunshade is suspended on the said fastening elements. The first and second fastening elements are attached to the side edges of the transparent sheet.

14 Claims, 4 Drawing Sheets

METHOD AND FASTENING ELEMENT FOR INSTALLING A SUNSHADE IN A GLAZING PART

CROSS REFERENCE TO RELATED APPLICATION

The present application claims priority from Finish Patent Application No. 20145746, filed Aug. 28, 2014.

FIELD

The invention relates to a method for installing, a sunshade to a glazing part, the glazing part comprising a transparent sheet with a first end edge and a second end edge, and a first side edge and a second side edge, the side edges being free edges of the sheet, and in which method at least one first fastening element is attached close to the first end edge of the transparent sheet and at least one second fastening element is attached close to the second end edge of the transparent sheet, and the sunshade is suspended on the said fastening elements. The invention further relates to a fastening element of a sunshade with gripping means for attachment to the glazing part and a fastening body for attaching to the sunshade.

BACKGROUND

Blinds are often used as sunshades in glazed balconies to prevent insolation from accessing the balcony. Sunshades are attached to the edge profiles in the upper and lower edges of the balcony glazing with fastening elements, which have gripping means for attaching to the sunshade and a suspension element for attaching to the edge profile.

Fastening elements used in the fastening of sunshades are usually metal parts, which encircle at least in part the edge profile of the glazing. Dust and dirt are easily accumulated to such fastening elements and especially to the gap between the fastener and edge profile, which is difficult to remove. The fastening elements are locked into place usually by means of a tight fit between the fastening element and edge profile. Due to the dimensional variances of the edge profiles and fastening elements and the sagging of the paint surface of the edge profiles it is often difficult to install the fastening elements dimensioned for the tight fit.

SUMMARY

It is an object of the invention to introduce a method for attaching the sunshade to the glazing part and a fastening element, with which disadvantages and drawbacks related to the state of the art can be eliminated.

The objects of the invention are achieved with a method and fastening element, which are characterized in what is presented in the independent claims. Some advantageous embodiments of the invention are disclosed in the dependent claims.

The invention relates to a method for installing a sunshade to a glazing part comprising a transparent sheet. The transparent sheet has a first end edge and a second end edge, and a first side edge and a second side edge. The end and side edges in this presentation refer to the side surface perpendicular to the plane of the transparent sheet and the narrow edge strip parallel to the plane on both sides of the transparent sheet, which edge strip borders to the side surface. The side edges are free edges of the sheet, i.e. no edge profiles have been attached to the side edges, which would cover or embed part of the side edge. In the method at least one first fastening element is attached close to the first end edge of the transparent sheet and at least one second fastening element is attached close to the second end edge of the transparent sheet and the sunshade is suspended on the said fastening elements. In the method said first and second fastening elements are attached to the side edges of the transparent sheet. The fastening elements are preferably attached to both side edges of the transparent sheet so that there are two first fastening elements close to the first end edge of the transparent sheet and two second fastening elements close to the second end edge of the transparent sheet. Typically in the glazing part installed in place the first and second side edges are in a substantially vertical position.

In an advantageous embodiment of the method of the invention the said sunshade comprises at least one guide wire with a first end and a second end. In the method the first end of the guide wire is attached to the first fastening element, the second end of the guide wire is attached to the second fastening element and the guide wire is tightened to an appropriate tightness. Sunshades used in balcony glazing typically have two guide wires, the first one of which is located in the first edge of the sunshade and the other one in the second edge of the sunshade. In this case the first guide wire is attached to the fastening elements to be fastened to the first side edge of the transparent sheet and the second guide wire is attached to the fastening elements to be fastened to the second side edge of the transparent sheet. The curtain section of the sunshade providing protection against insolation is supported to the guide wires so that the sunshade can be unfolded into an open position, in which it covers the transparent sheet substantially entirely, and pressed it into a folded position, in which it covers as small a portion as possible of the area of the transparent sheet.

In a second advantageous embodiment of the invention the fastening element is arranged tightly around a section of the side edge of the transparent sheet. The fastening element then stays in place in the edge of the transparent sheet by means of friction caused by the tight fit between the transparent sheet and fastening element. The friction between the transparent sheet and fastening element can be increased by arranging a friction-increasing friction element between the fastening element and the transparent sheet. The friction element can be, for example, a flexible friction lamella arranged onto the surface of the fastening element settling against the transparent sheet.

In yet another advantageous embodiment of the method of the invention the sunshade is attached to the fastening element so that the force applied from the sun shade to the fastening element increases the force applied from the fastening element to the transparent sheet. Such an attachment can be realised, for example, so that the sunshade is attached eccentrically in relation to the vertical travelling through the mass-centre of the fastening element, in which case the load generated by the sunshade attempts to turn the fastening element attached to the edge of the transparent sheet. The turning movement of the fastening element makes the edge section of the fastening element surrounding the side edge of the transparent sheet to press strongly against the surface of the transparent sheet. The force applied from the sunshade to the fastening element can be adjusted, for example, by tightening the guide wires of the sunshade to an appropriate tightness.

In yet another advantageous embodiment of the method of the invention the fastening element is attached to the side edge of the transparent sheet by glue or a stick-on label. The glue or stick-on label can extend in the side edge to the one or both surfaces parallel to the transparent sheet and/or to the side surface of the transparent sheet.

In yet another advantageous embodiment of the method of the invention the fastening element is pressed around a section of the side edge of the transparent sheet by spring force. The compression achieved by the spring force also increases the friction force keeping the fastening element in place. The fastening element can also be pressed around a section of the side edge of the transparent sheet by using a tightening screw. In this case the tightening screw is arranged to the fastening element so that its point is pressed against the surface of the transparent sheet. A compression sheet can be arranged between the point of the tightening screw and the surface of the transparent sheet, the surface of the compression sheet being pressed against the surface of the transparent sheet.

In yet another advantageous embodiment of the method of the invention the fastening elements are attached to the glazing part, in which the first end edge of the transparent sheet has a first edge profile and the first fastening element is attached to the first edge profile in addition to the side edge. The second end edge of the transparent sheet preferably has a second edge profile and the second fastening element is attached to the second edge profile in addition to the side edge. By means of the attachment to the edge profiles it is ensured that the fastening elements cannot glide towards each other in the direction of the side edge.

In the fastening element of a sunshade, which is an object of the invention, there are gripping means for attaching to the glazing part and a fastening body for fastening to the sunshade. Said gripping means comprise a slot formed by a first flank, a second flank, and a base connecting the flanks to which slot it is possible to fit the free side edge of the transparent sheet of the glazing part. The side edges in this presentation refer to the side surface perpendicular to the direction of the plane of the transparent sheet and the narrow edge strip parallel to the plane on both sides of the transparent sheet, which borders to the side surface. Preferably said fastening body comprises a fastening projection in the second flank of the fastening element.

One advantageous embodiment of the fastening element of the invention comprises a fastening hole or slot for attaching the guide wire of the sunshade. It is preferable to arrange the fastening hole or slot to the fastening projection. The pulling force of the guide wire causes a bending moment to the fastening projection, which attempts to rotate the fastening element and especially its one flank. The rotation of the fastening element increases the compression and friction force acting between the flanks and the transparent sheet, which promotes the fastening element to stay in place.

One advantageous embodiment of the fastening element of the invention comprises an interface for attaching to the edge rail of the sunshade. In this embodiment the edge rail of a sunshade, such as a blind, is attached directly to the interface of the fastening element. The interface may have a shaping, which is compatible with the shaping of the fastening surface settling against the interface of the edge rail. In this case the edge rail can set tightly against the interface and attach to the fastening element by means of the tight fit between the interface and the fastening surface. It is preferable to arrange the interface to the fastening projection.

A second advantageous embodiment of the fastening element of the invention comprises further a spring element for moving the first flank and the second flank towards each other. The fastening element can further comprise a friction element to be placed against the surface of the transparent sheet.

A third advantageous embodiment of the fastening element of the invention comprises a tightening screw, the point of which can be moved to the space between the first flank and the second flank. The fastening screw can extend through the first or second flank or base of the fastening element so that the head of the fastening screw is visible on the outer surface of the fastening element. By rotating the fastening screw its point is pressed to the gap between the surface of the transparent sheet and the flank and presses the first or second flank of the fastening element tightly against the surface of the transparent sheet. Because of the tightening screw the width of the slot limited by the first and second flank can be bigger than the thickness of the transparent sheet, and the same fastening element can be attached to transparent sheets of different thicknesses. A compression plate can be arranged to the space between the first and second flank, between the point of the tightening screw and the transparent sheet so that the surface of the compression plate is pressed against the surface of the transparent sheet when rotating the tightening screw.

Yet another advantageous embodiment of the fastening element of the invention comprises a support element for attaching to the edge profile of the glazing part.

In yet another advantageous embodiment of the fastening element of the invention the thickness of the base is less than 5 mm. The base of the attachment element of the invention settles to the gap between the adjacent glazing parts of the balcony glazing. By limiting the thickness of the base to be less than 5 mm it is ensured that the bases of the fastening elements do not increase the width of the gap between the glazing parts.

The fastening element of the invention can be a part formed of a thread-type piece or a part formed of a sheet-type piece. Preferably the fastening element is made of some easily formable, flexible material, such as plastic or metal.

It is an advantage of the invention that the sunshade can be attached to the glazing part fast and, easily without the use of tools. The dimensional variances and sagging of paint in the edge profiles of the glazing part do not prevent or make difficult the installation of the sunshade.

It is a further advantage of the invention that in the method the attached unshade does not cause dirtying of the edge profile of the glazing section or hinder the cleansing of the edge profile.

It is further an advantage of the invention that no visible traces remain in the glazing part from the attachment of the fastener, which would deteriorate the appearance of the glazing part.

BRIEF DESCRIPTION OF THE DRAWINGS

The invention will next be explained in detail, referring to the enclosed drawings, in which.

DETAILED DESCRIPTION OF THE INVENTION

Figure 1:
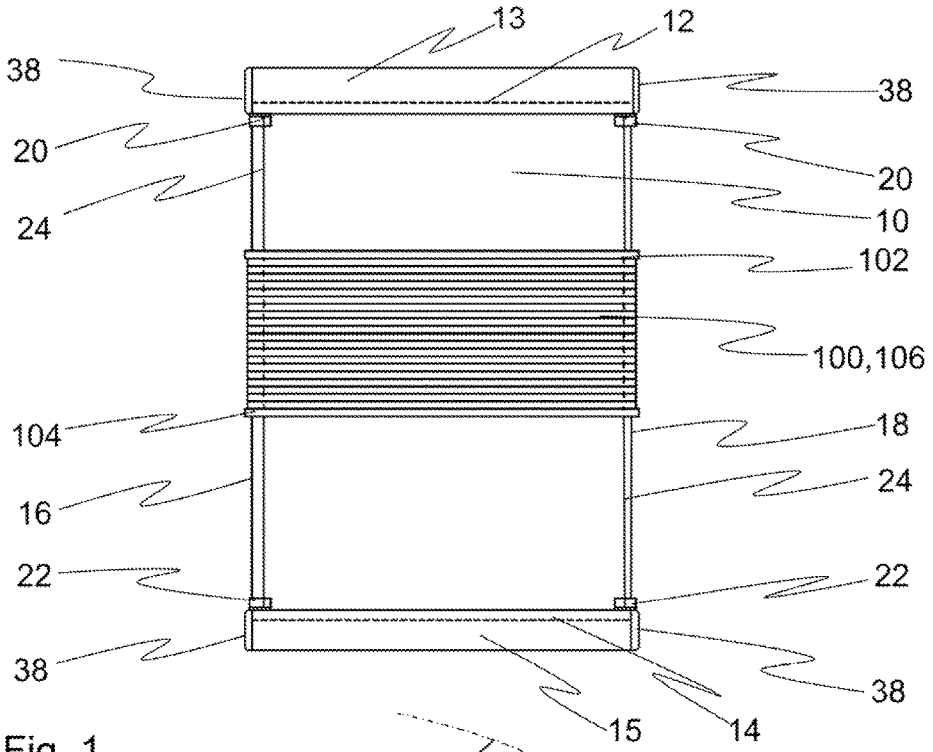
FIG. 1 is an exemplary illustration of a glazing part, to which a sunshade h been installed using the method of the invention.

In FIG. 1 there is illustrated a glazing part for balcony glazing, to which a sunshade has been installed by using the method of the invention. The glazing part comprises a rectangular transparent sheet 10 with two parallel side edges, the first side edge 16 and the second side edge 18, and two parallel end edges, the first end edge 12 and the second end edge 14. The transparent sheets used in balcony glazing are typically made of hardened glass with a thickness of 4-6 mm, but also other materials and sheet thicknesses are possible. The first end edge of the transparent sheet has the first edge profile 13 and the second end edge has the second edge profile 15. The edge profiles are aluminium profiles, which have a groove to which the end edge of the transparent sheet 10 has been fitted. The ends of the edge profiles are provided with plastic end pieces 38. The side edges 16, 18 of the transparent sheet are free edges, in other words edges with no edge profile.

In the method of the invention fastening elements 20, 22 are attached to the glazing part, the sunshade 100 being suspended on the fastening elements. The first fastening elements 20 are attached to the first and second side edge 16, 18 of the transparent sheet 10, as close to the first end edge 12 as possible. In practice the first fastening elements are attached to the side edges so that they are settled in contact with the first edge profile 13. The second fastening element 22 are attached to the first and second side edge 16, 18 of the transparent sheet 10, as close to the second end edge 14 as possible. In practice the second fastening elements are installed to contact the second edge profile 15. After the fastening elements have been installed in place, the guide wires 24 belonging to the sunshade are attached to the first fastening element 20 from their first end and to the second fastening element 22 from their second end, and tightened. The sunshade typically has two guide wires so that the first guide wire is attached to the fastening elements attached to the first side edge 16 of the transparent sheet and the second guide wire is attached to the fastening elements attached to the second side edge 18 of the transparent sheet. The curtain section of the sunshade offering protection from insolation comprises an upper rail 102, a lower rail 104 and between them a curtain 106 folded into zig-zag form. The upper and lower rail can be moved on the guide wires up and down so that the area of the region covered by the curtain 106 changes.

Figure 2:
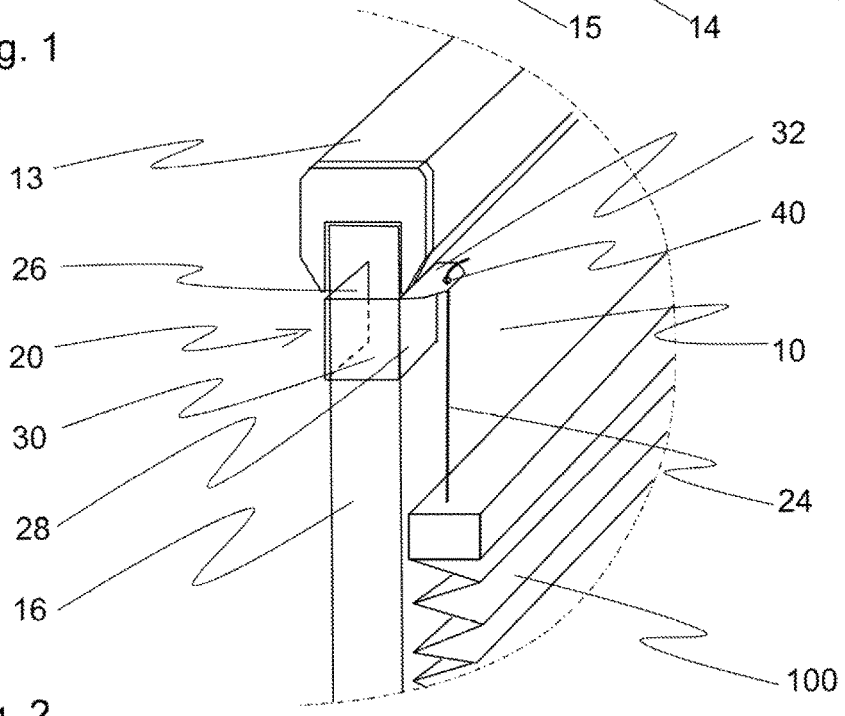
FIG. 2 illustrates a corner of the glazing part of FIG. 1 as partial enlargement.

FIG. 2 illustrates in an exemplary way the upper corner of the glazing part shown in FIG. 1, i.e. the corner formed by the first end edge and the first side edge 16 of the transparent sheet 10. In the Figure there is shown the attachment of the first fastening element 20 to the first side edge of the transparent sheet 10. The fastening element has a first flank 26, a second flank 28, and a base 30 connecting said flanks. The flanks and the base form a slot, the width of which is substantially equal to the thickness of the transparent sheet 10. In the edge of the second flank there is provided a tongue, which is folded substantially to a right angle from the plane of the second flank so that it forms a fastening projection 32. The corners of the fastening projection are bevelled, and close to its end there is the hole 40 for attaching a guide wire 24 of the sunshade 100. The fastening element has been formed by shaping a thin metal sheet into U-form and by turning the tongue formed to the flank of the second branch of U outwards as the fastening projection 32. The thickness of the metal sheet can be approximately 0.5-1.0 mm.

The fastening element is attached in place to the transparent sheet 10 by fitting the first side edge 16 to the slot of the fastening element so that the first flank 26 of the fastening element is settled on the first side of the sheet, the second flank 28 is settled to the second side of the sheet, and the base 30 is pressed against the edge, surface of the first side edge of the sheet. The width of the base 30, i.e. the distance between the first and second flank, has been selected so that it is substantially equal to the thickness of the transparent sheet 10. The fastening element has been made of a metal sheet behaving in a spring-like manner into such a shape that in the free state the flanks 26, 28 turn towards each other. Upon installing the fastening element, the flanks thus have to be folded apart from each other so that spring force is stored to the fastening element. In the fastening element 20 installed in place, the spring force presses the flanks 26, 28 tightly against the surface of the transparent sheet so that friction force is generated between the flanks and the surface of the transparent sheet, preventing the movement of the fastening element.

In FIG. 2 there is illustrated the attachment of one fastening element 20 to the side edge of the transparent sheet 10 as close to the first end edge of the transparent sheet 10 as possible. In practice this means that the edges of the flanks 26, 28 of the fastening element 20 are placed to the edge profile 13 in the first end edge of the transparent sheet. The remaining fastening elements are attached to the side edges in similar manner. After the attachment of the fastening elements, guide wires 24 of the sunshade 100 are attached to them, after which the installation work of the sunshades is complete.

Figure 3:
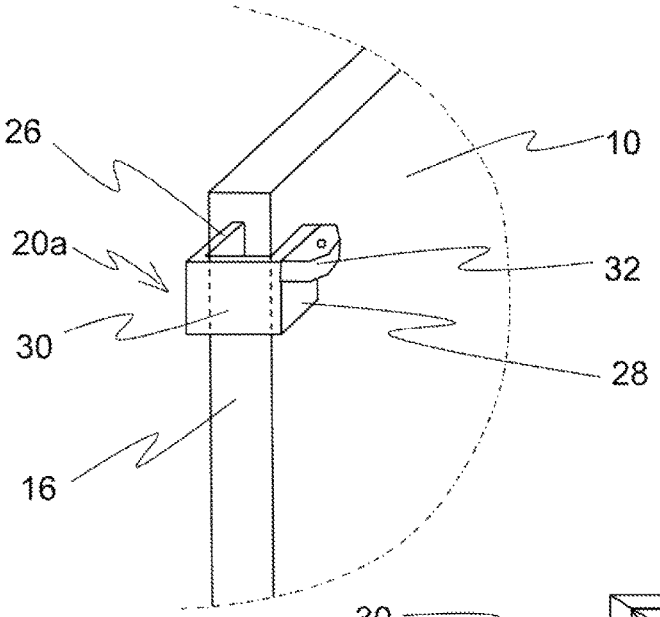
FIG. 3 is an exemplary illustration of an advantageous embodiment of the fastening element of the invention.

In FIG. 3 there is shown in an exemplary manner an advantageous embodiment of the fastening element 20*a* used in a method of the invention, attached to the first side edge of the transparent sheet 10. The embodiment in FIG. 3 is substantially of the same shape as in FIG. 2, i.e. it has the first flank 26, the base 30, the second flank 28 and the fastening projection 32 turning from the point of the second flank to an angle. This embodiment has been prepared by casting from flexible plastic material, and the material thicknesses of its parts are substantially bigger than in FIG. 2. The distance between the flanks has been chosen so that the side edge 16 of the transparent sheet 10 settles between the flanks with a tight fit. The fastening element stays in place in the side edge due to the compression and friction forces generated by the tight fit.

Figure 4A:
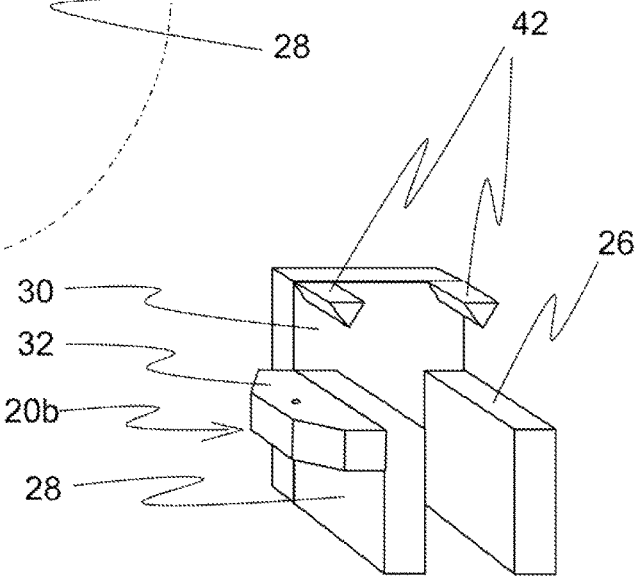
FIGS. 4*a* and 4*b* illustrate second advantageous embodiment of the fastening element of the invention.
Figure 4B:
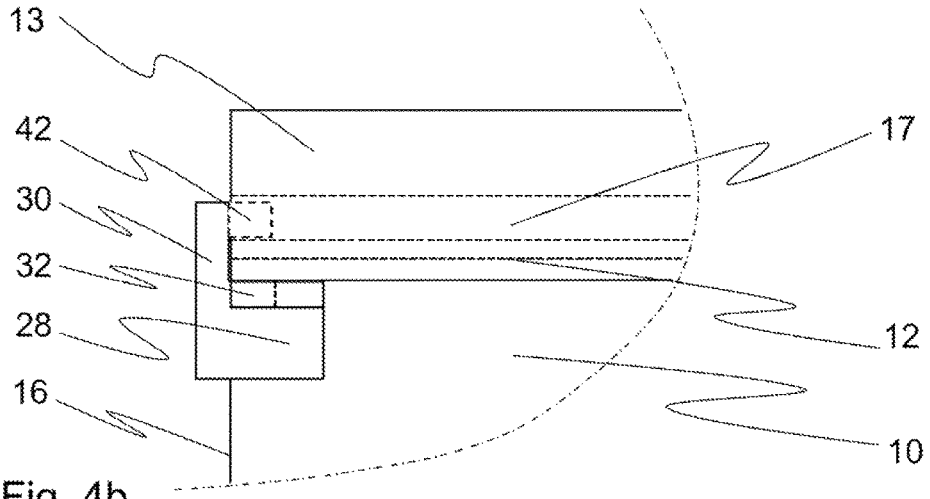

FIGS. 4*a* and 4*b* illustrate in an exemplary manner a second advantageous embodiment of the fastening element 20*b* used in the method of the invention. FIG. 4*a* illustrates the embodiment as a separate part and in FIG. 4*b* the embodiment is shown installed in place to the glazing part. The embodiment shown in the Figures is substantially of a similar shape as in FIG. 3, i.e. it has the first flank 26, the base 30, the second flank 28, and the fastening projection 32 turning to an angle from the second flank. This embodiment has been made by casting from flexible plastic material and the distance between the flanks has been chosen so that the side edge 16 of the transparent sheet 10 settles between the flanks with a tight fit. In this embodiment the base 30 extends above the plane defined the flank edges, and the base has two support elements 42 parallel to the flanks. The size and shape of the support elements has been chosen so that they can be fitted to the cavities 17 opening to the end surface of the first edge profile 13 in the first end edge 12 of the transparent sheet 10 (FIG. 4*b*). The base can be made so big that it substantially covers the entire end surface of the edge profile. In this case there is no need for a separate end piece at the end of the edge profile.

Figure 5:
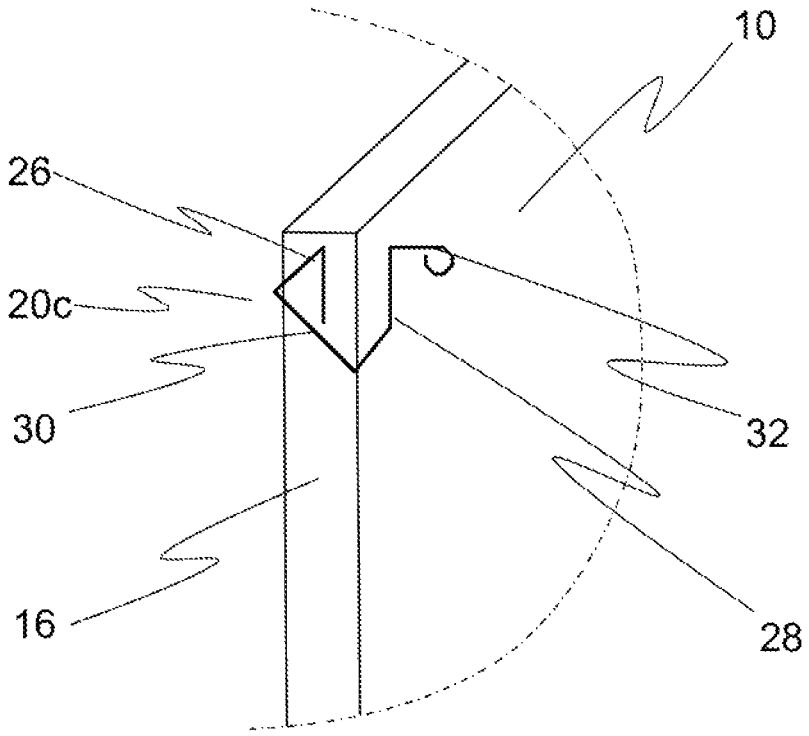
FIG. 5 illustrates a third advantageous embodiment of the fastening element of the invention.

In FIG. 5 there is illustrated in an exemplary manner a third embodiment of the fastening element 20*c* used in the method of the invention, attached to the first side edge 16 of the transparent sheet 10. The embodiment in FIG. 5 has the first flank 26, the base 30, the second flank 28, and the fastening projection 32 turning from the point of the second flank to an angle, i.e. it has the same functional elements as the embodiments in FIGS. 2 and 3. This embodiment has been made by shaping a metal wire behaving in a spring-like manner into the shape shown in FIG. 5. Therefore, its appearance deviates distinctly from the previously shown embodiments. The distance between the flanks formed of the metal wire has been selected so that the side edge 16 of the transparent sheet 10 settles between the flanks with a tight fit. The fastening element stays in place, in the side edge because of the compression and friction force generated by the tight fit.

Figure 6A:
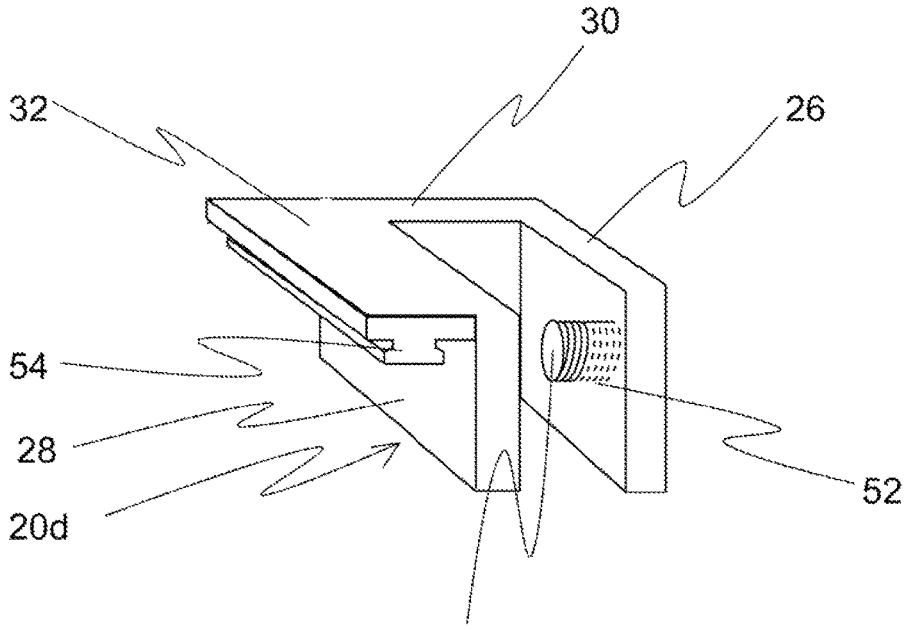
FIGS. 6*a* and 6*b* illustrate a fourth advantageous embodiment of the fastening element of the invention.
Figure 6B:
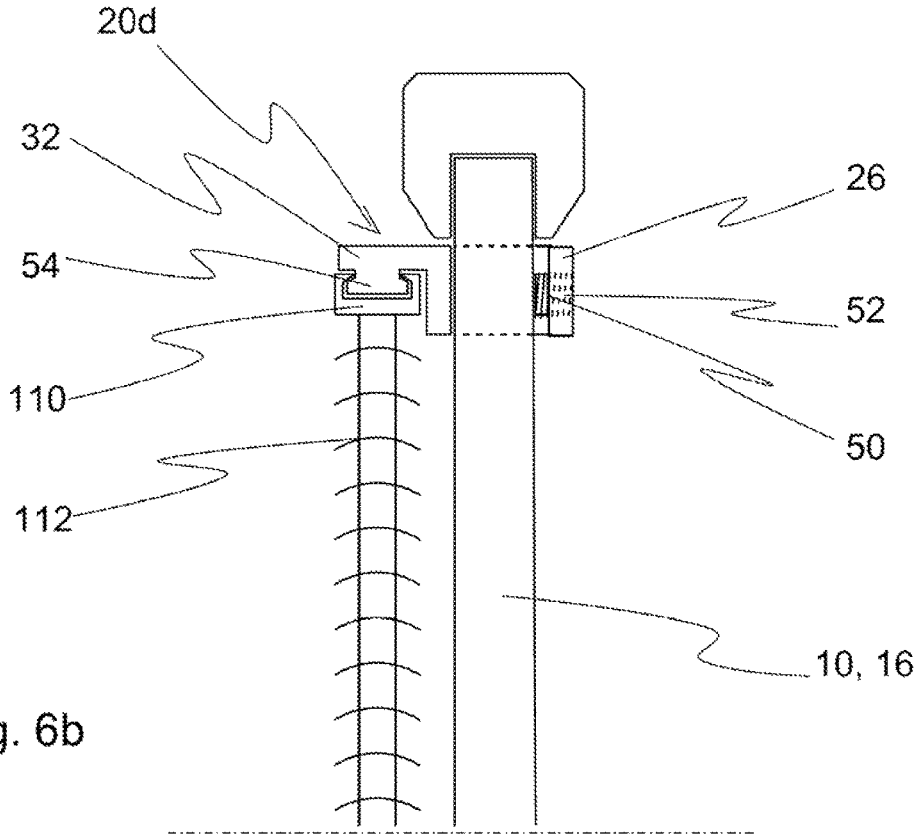

FIGS. 6*a* and 6*b* illustrate in an exemplary manner an advantageous fourth embodiment 20*d* of the fastening element used in the method of the invention. FIG. 6*a* illustrates the fastening element as a separate part and FIG. 6*b* illustrates the fastening element installed in place to the glazing element of the balcony glazing. In the embodiment shown in FIGS. 6*a* and 6*b* there is the first flank 26, the base 30, the second flank 28 and the fastening projection 32 turning to an angle from the second flank. The embodiment of the fastening element has been made by casting from plastic material. The distance between the flanks has been chosen so that the side edge 16 of the transparent sheet 10 can be placed loosely between the flanks, i.e. the distance between the flanks is clearly bigger than the thickness of the transparent sheet (FIG. 6*b*). The first flank 26 has a threaded through-hole 52, to which a plastic tightening screw 50 is fitted. The point of the tightening screw extends to the gap between the first and second flank, and the head of the tightening screw can be seen outside the fastening element through the hole 52. The fastening element is fitted in place to the side edge 16 of the transparent sheet 10 so that the side edge is settled between the flanks. Attaching the fastening element in place is effected by tightening the tightening screw so that the point of the tightening screw is pressed against the surface of the transparent sheet. The fastening element stays in place in the side edge due to the compression and friction force generated by the fastening screw between the second flank 28 and the transparent sheet 10.

An elongated neck 54 is shaped to the second surface of the fastening projection 32, the cross-sectional shape of which is substantially similar to that of the groove in the edge rail 110 of the sunshade 100 to be attached to the fastening element. The edge rail of the sunshade can thus be attached to the fastening element simply by fitting the necks of the fastening elements to the groove in the edge rail in the way illustrated in FIG. 6*b*. The surface of the fastening element facing the neck thus forms an interface, to which the sunshade can be attached without separate fastening bodies. The sunshade can be, for example, a blind comprising several laths 112 hanging on wires from the edge rail 110.

The embodiment illustrated in FIGS. 6*a* and 6*b* comprises both the tightening screw 50 for attaching the fastening element to the transparent sheet 10 and the interface for attaching the edge rail of the sunshade. It is evident that these features are not dependent from each other, i.e. embodiments comprising only one of the above-mentioned features can be made of the fastening element 20*d*.

The fastening elements illustrated in FIGS. 2-6 can be provided with one or several friction elements, which in the fastening element installed in place settle against the surface of the transparent sheet. Natural places for the friction elements are the surfaces of the first and second flank and base settling against the surface of the transparent sheet. The friction element can, for example, comprise friction lamellas or bulges, which prevent the friction element from gliding along the surface of the transparent sheet. Further, to ensure the attachment of the fastening element, glue or self-adhesive stickers can be used on the contact surface between the fastening element and the transparent sheet. FIGS. 2-6 only describe the first fastening elements and their structure. The second fastening elements have a similar or corresponding structure as the first fastening elements.

Some advantageous embodiments of the method and fastening element of the invention have been described above. The invention is not restricted to the solutions described above, but the inventional idea can be applied in different ways within the scope defined by the patent claims.

The invention claimed is:

1. A method for installing a sunshade to a glazing part comprising a transparent sheet with a first end edge and second end edge and a first side edge and second side edge, which first and second side edges are free edges of the transparent sheet, the method comprising:

providing the sunshade with a first guide wire and a second guide wire, attaching at least one first fastening element relative to the first end edge of the transparent sheet and attaching at least one second fastening element relative to the second end edge of the transparent sheet such that to make the sunshade cover an entire transparent area of the transparent sheet, the first and second fastening elements are in contact with edge profiles in the first and second end edges of the transparent sheet, and suspending the sunshade on the first and second fastening elements so that the first and second fastening elements are attached to the first and second side edges of the transparent sheet; and attaching the first guide wire to the first and second fastening elements attached to the first side edge of the transparent sheet, and the second guide wire to the first and second fastening elements attached to the second side edge of the transparent sheet.

2. A method according to claim 1, wherein the first and second side edges are in a substantially vertical position in the glazing part installed in place.

3. A method according to claim 1, wherein each of the first and second guide wires has a first end and a second end, the first end of each of the first and second guide wires is attached to the at least one fastening element, the second end of each of the first and second guide wires is attached to the at least second fastening element, and the first and second guide wires are tightened.

4. The method according to claim 1, wherein each of the first and second fastening elements comprises a first flank, a second flank and a base, and is arranged around a section of the first and second side edges of the transparent sheet so that the first flank is settled on a first side of the transparent sheet, the second flank is settled on a second side of the transparent sheet and the base is pressed against edge surfaces of the first and second side edges.

5. The method according to claim 1, further comprising arranging a friction-increasing friction element between the first and second fastening elements and the transparent sheet.

6. The method according to claim 1, further comprising attaching the sunshade to the first and second fastening elements so that the force applied from the sunshade to the first and second fastening elements increases the force applied from the first and second fastening elements to the transparent sheet.

7. The method according to claim 1, further comprising attaching the first and second fastening elements to the first and second side edges of the transparent sheet with glue.

8. The method according to claim 1, further comprising pressing the first and second fastening elements around a section of the first and second side edges of the transparent sheet with spring force.

9. The method according to claim 1, further comprising pressing the first and second fastening elements around a section of the first and second side edges of the transparent sheet with a tightening screw.

10. The method according to claim 1, further comprising attaching the first and second fastening elements to the glazing part, in which the first end edge of the transparent sheet has a first edge profile, and attaching the at least one first fastening element also to the first edge profile in addition to the first side edge.

11. The method according to claim 1, further comprising attaching the first and second fastening elements to the glazing part, in which the second end edge of the transparent sheet has a second edge profile, and attaching the at least one second fastening element to the second edge profile in addition to the second side edge.

12. A method for installing a sunshade to a glazing part comprising a transparent sheet with a first end edge and second end edge and a first side edge and second side edge, which first and second side edges are free edges of the sheet, the method comprising:

attaching at least one first fastening element relative to the first end edge of the transparent sheet and attaching at least one second fastening element relative to the second end edge of the transparent sheet such that to make the sunshade cover an entire transparent area of the transparent sheet, the first and second fastening elements are in contact with edge profiles in the first and second end edges of the transparent sheet, and suspending the sunshade on the first and second fastening elements so that the first and second fastening elements are attached to the first and second side edges of the transparent sheet, the method further comprising attaching the sunshade to the first and second fastening elements so that the force applied from the sunshade to the first and second fastening elements increases the force applied from the first and second fastening elements to the transparent sheet.

13. A method for installing a sunshade to a glazing part comprising a transparent sheet with a first end edge and second end edge and a first side edge and second side edge, which first and second side edges are free edges of the sheet, the method comprising:

attaching at least one first fastening element relative to the first end edge of the transparent sheet and attaching at least one second fastening element relative to the second end edge of the transparent sheet such that to make the sunshade cover an entire transparent area of the transparent sheet, the first and second fastening elements are in contact with edge profiles in the first and second end edges of the transparent sheet, and suspending the sunshade on the first and second fastening elements so that the first and second fastening elements are attached to the first and second side edges of the transparent sheet, the method further comprising attaching the first and second fastening elements to the glazing part, in which the first end edge of the transparent sheet has a first edge profile, and attaching the at least one first fastening element also to the first edge profile in addition to the first side edge.

14. A method for installing a sunshade to a glazing part comprising a transparent sheet with a first end edge and second end edge and a first side edge and second side edge, which first and second side edges are free edges of the sheet, the method comprising:

attaching at least one first fastening element relative to the first end edge of the transparent sheet and attaching at least one second fastening element relative to the second end edge of the transparent sheet such that to make the sunshade cover an entire transparent area of the transparent sheet, the first and second fastening elements are in contact with edge profiles in the first and second end edges of the transparent sheet, and suspending the sunshade on the first and second fastening elements so that the first and second fastening elements are attached to the first and second side edges of the transparent sheet, the method further comprising attaching the first and second fastening elements to the glazing part, in which the second end edge of the transparent sheet has a second edge profile, and attaching the at least one second fastening element to the second edge profile in addition to the second side edge.

* * * * *